United States Patent [19]

Watanabe

[11] Patent Number: 4,471,743

[45] Date of Patent: Sep. 18, 1984

[54] FUEL INJECTION CONTROL SYSTEM

[75] Inventor: Haruo Watanabe, Okazaki, Japan

[73] Assignee: Toyota Jidosha Kabushiki Kaisha, Toyota, Japan

[21] Appl. No.: 420,942

[22] Filed: Sep. 21, 1982

[30] Foreign Application Priority Data

Oct. 2, 1981 [JP] Japan ..... 56-157766

[51] Int. Cl.[3] ..... F02D 5/02

[52] U.S. Cl. ..... 123/492; 123/480

[58] Field of Search ..... 123/478, 480, 486, 492, 123/493

[56] References Cited

U.S. PATENT DOCUMENTS 3,969,614 7/1976 Moyer et al. ..... 123/480
4,204,483 5/1980 Harada et al. ..... 123/493
4,249,498 2/1981 Drews et al. ..... 123/478
4,335,695 6/1982 Phipps ..... 123/478

*Primary Examiner*—Andrew M. Dolinar
*Attorney, Agent, or Firm*—Cushman, Darby & Cushman

[57] ABSTRACT

An injector is driven in response to a basic injection pulse signal having a pulse width extracted from an engine rotational speed and an intake air flow rate. It is judged that an engine is in normal operation only after the engine has performed predetermined rotations from a moment at which a throttle valve begins to open. During normal operation of the engine, a time period for limiting a pulse width corresponding to an engine rotational speed is selected, and, after this time period has elapsed, a pulse cut signal is generated to interrupt fuel injection of the injector in spite of the presence of the basic injection pulse signal. The basic fuel injection pulse signal is not cut under a transitional condition of the engine.

8 Claims, 9 Drawing Figures

FIG. 5
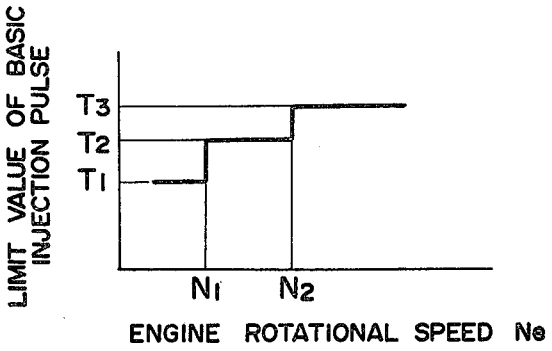
FIG. 6A
TIMER 48
FIG. 6B
PULSE Ti
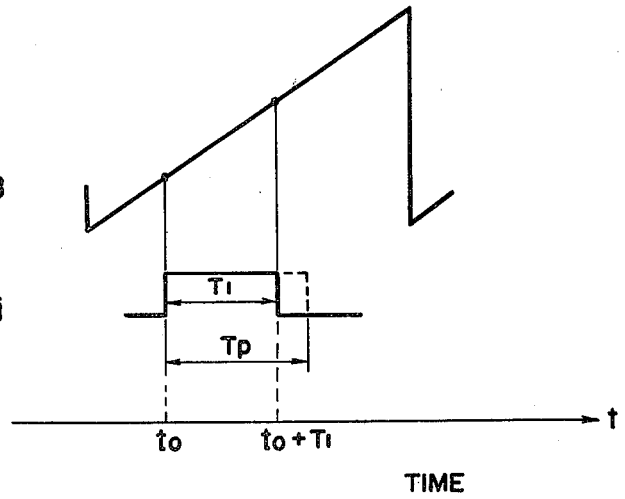

FUEL INJECTION CONTROL SYSTEM

BACKGROUND OF THE INVENTION

This invention relates to fuel injection control systems, and more particularly to a fuel injection control system wherein a fuel injection flow rate in each cylinder is controlled in such a manner that the optimum air-fuel ratio is obtainable in each cylinder.

In the fuel injection control system of the type described, a basic fuel injection flow rate, which is extracted from an intake air flow rate and an engine rotational speed, is corrected by various data on the driving conditions of the engine such as engine cooling water temperature, intake air temperature, or a residual oxygen concentration so as to keep the air to fuel ratio at the optimum value, and satisfactory driving performance is maintained. In consequence, unless the intake air flow rate is accurately metered, the air-fuel ratio can not be controlled to the optimum value.

There has been commonly used an intake air flow rate sensor (air flow meter) having a measuring plate which is interposed between an air cleaner and a throttle valve and is rotatably driven commensurate to an air flow into the engine to cunvert a rotational angle (opening degree) of the measuring plate into a voltage so as to detect an intake air flow rate. As shown in FIG. 1, in the air flow meter of the type described, an opening degree of the measuring plate of the air flow meter is logarithmically varied for a differential pressure $\Delta P$ between the front and rear sides of the air flow meter in a throttle chamber to maintain a measuring accuracy even when the intake air flow rate is low.

When the engine is fully loaded, a pulsating flow of the intake are generated, in which case, the differential pressure $\Delta P$ is varied in a sine-wave form between $P_1$ and $P_2$, being centered about $P_n$ as shown in FIG. 1. At this time, the central opening degree of the measuring plate becomes an opening degree b larger in value than a mean value between opening degrees $a_0$ and $a_1$ corresponding to pressures $P_0$ and $P_1$, and a value larger than the actual intake air flow rate is detected by the air flow meter.

As a result, when the engine is fully loaded, a fuel injection signal making the fuel injection flow rate to be excessively large, i.e., the air-fuel ratio to be over-rich is emitted from the fuel injection control system to an injector, thus resulting in a decreased engine output and a lowered efficiency of purifying an exhaust gas.

To avoid occurrence of the above-described phenomenon, there is a method of reducing the fuel increasing rate under the full-load of the engine, a method of imposing an upper limit to the pulse width of fuel injection pulses under the same, or the like. However, during the transitional condition of the engine such as racing, an over-rich air-fuel ratio is required as compared with that when the engine is in full-load. Therefore, if merely the fuel injection flow rate is set to the optimum value at the time of full-load of the engine, there are presented problems of that the engine does not reach a required rotational speed and so forth.

SUMMARY OF THE INVENTION

The present invention has as its object the provision of a fuel injection control system wherein, while the response during the transitional condition of the engine is maintained satisfactorily, an air-fuel ratio at the time of full-load of an engine is controlled to the optimum value so as to optimize the fuel consumption rate and the discharge of the exhaust gas.

In the fuel injection control system according to the present invention, during the transitional condition of the engine, fuel is injected from an injector in response to a basic injection pulse signal having a pulse width determined by the engine rotational speed and intake air flow rate, and during the normal condition of the engine, an injection pulse cut signal for limiting the pulse width of the basic injection pulse signal is caused to be generated at a predetermined timing to cut the basic injection pulse signal, whereby the injection of fuel from the injector is interrupted.

BRIEF DESCRIPTION OF THE DRAWINGS

FIG. 5 shows the relationship between the engine rotational speed and the limited value of the basic injection pulses;

FIGS. 6A and 6B are time charts in explanation of operation of the timer when the basic injection pulses are controlled to be limited;

DESCRIPTION OF THE PREFERRED EMBODIMENT

Figure 1:
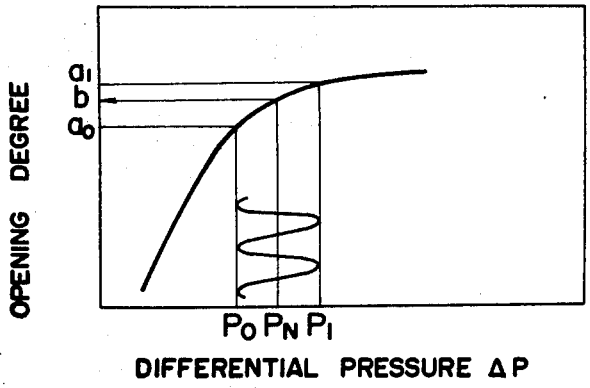
FIG. 1 is a characteristics diagram of the air flow meter.
Figure 2:
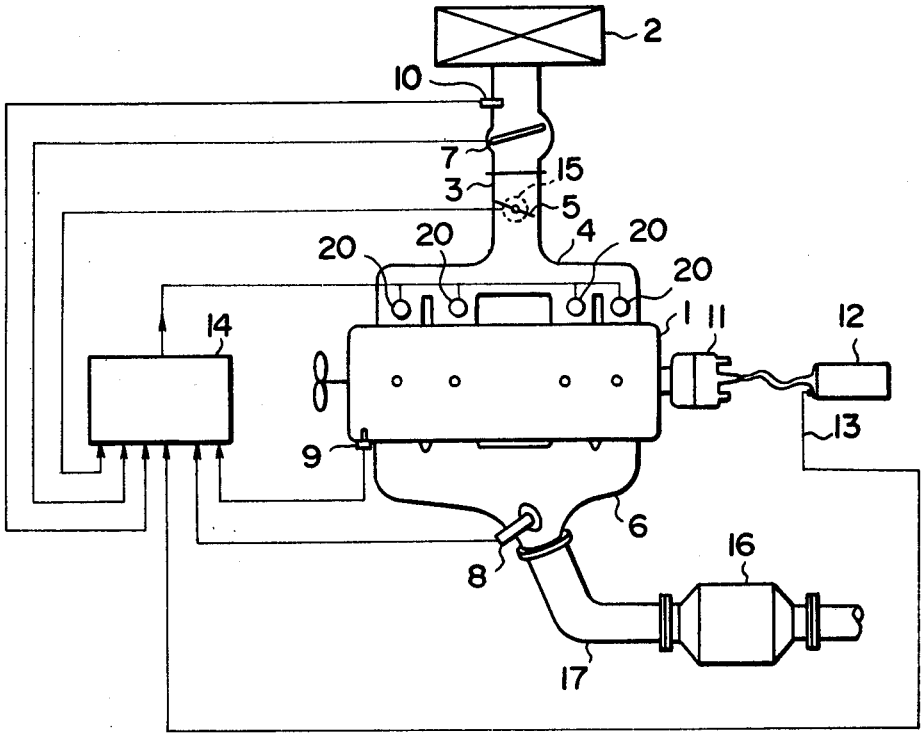
FIG. 2 is a general arrangement view of the engine system.

FIG. 2 shows the general arrangement of the engine system in an embodiment of the present invention, in which reference numeral 1 indicates an engine, 2 an air cleaner, 3 a throttle chamber, 4 an intake manifold for feeding air to respective cylinders, 6 an exhaust manifold for introducing the exhaust gas in the respective cylinders into an exhaust pipe 17, and 16 a three-way catalyst. Here, an accelerator pedal, not shown, is operated to control the opening degree of a throttle valve 5 provided in the throttle chamber 3, whereby a flow rate of air fed to the respective cylinders of the engine 1 from the air cleaner 2 is controlled. The throttle valve 5 is provided thereon with a throttle sensor 15 for detecting whether the throttle valve 5 is fully closed or not, i.e., the engine is in the idling operation or not, and a detection output from the throttle sensor 15 is fed to a control circuit 14. The throttle sensor 15 is turned "ON" when the throttle valve 5 is fully closed.

The air flow rate controlled by opening or closing of the throttle valve 5 is metered by an air flow meter 7 provided at the upstream side of the throttle valve 5 in the throttle chamber 3, and a detection signal therefrom is fed to the control circuit 14.

Reference numeral 8 designates an $O_2$ sensor provided in the vicinity of an outlet of the exhaust manifold 6 for detecting a residual oxygen concentration in the exhaust gas. Reference numeral 9 denotes a water temperature sensor for detecting engine cooling water temperature, and 10 an intake air temperature sensor for detecting the temperature of intake air. Detection signals emitted from these sensors 8, 9 and 10 are fed to the control circuit 14.

Reference numeral 12 designates an ignition circuit for feeding ignition signals to ignition plugs provided on the respective cylinders through a distributor 11. An ignition coil primary signal 13 from the ignition circuit 12 is fed to the control circuit 14, and this signal 13 is processed as an engine rotational speed signal in the control circuit 14.

The control circuit 14 extracts a basic fuel injection flow rate on the basis of the intake air flow rate and the engine rotational speed signal, and further, corrects the fuel injection flow rate on the basis of the signals from the sensors 8, 9, 10 and various sensors to be described hereunder so that the air-fuel ratio approaches an ideal air-fuel ratio and the drivability of the engine.

Figure 3:
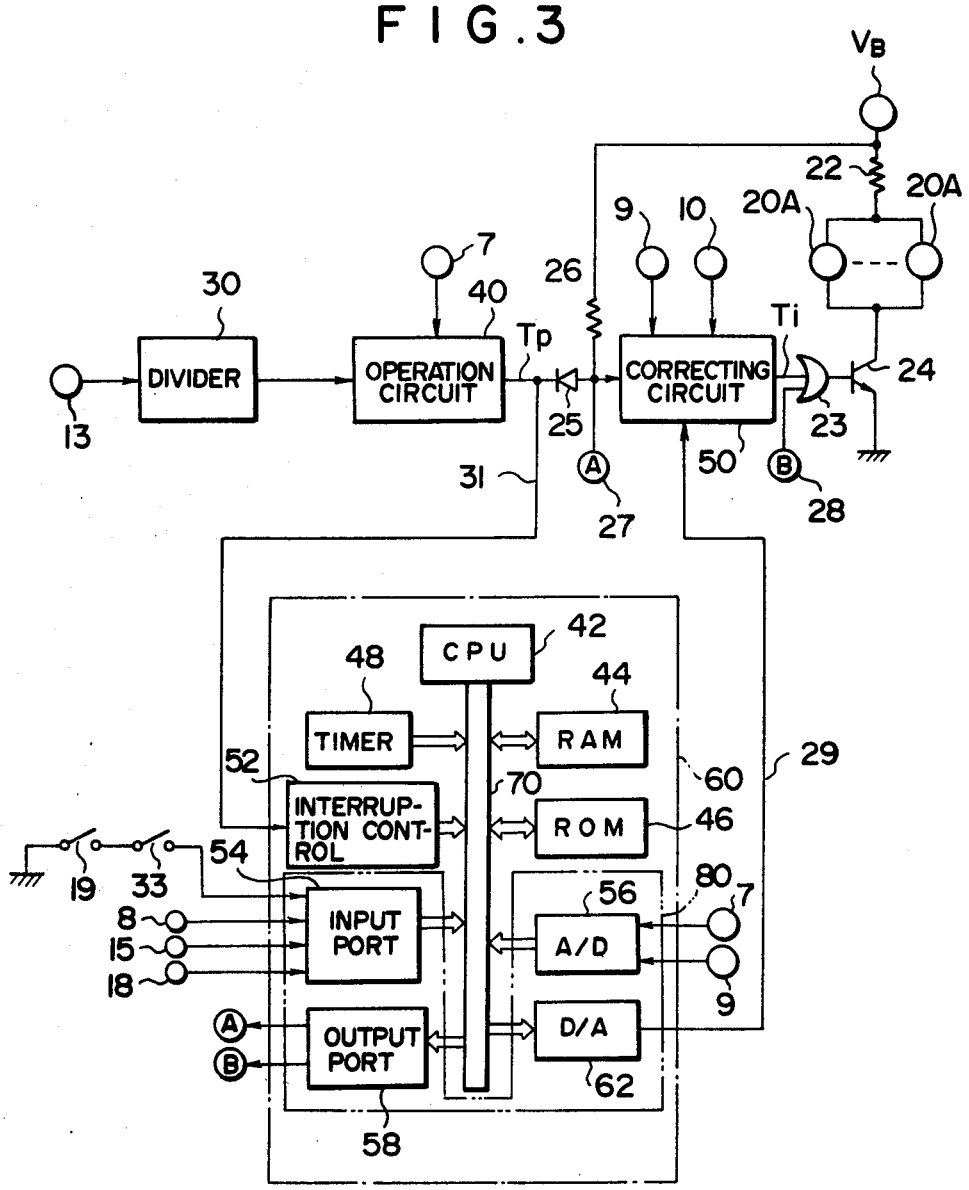
FIG. 3 is a block diagram showing the specific arrangement of the control circuit 14.

FIG. 3 shows the specific arrangement of the control circuit 14, in which reference numeral 30 denotes a frequency dividing circuit, which takes in the ignition coil primary signal 13 which is divided by a predetermined dividing ratio, so that pulse signals are produced to be fed to a basic injection flow rate operation circuit 40.

An injection flow rate correcting circuit 50 takes in basic injection pulses having a pulse width $T_p$ determined on the basis of the flow rate detected by the air flow meter 7 from the basic injection flow rate operation circuit 40 through a diode 25 at the timing of a pulse signal from the frequency dividing circuit 30. Further, the basic injection pulses are fed to an interruption control section 52 in a microcomputer 60 as well. The injection flow rate correcting circuit 50 takes in detection signals from the water temperature sensor 9, the intake air temperature sensor 10 and an air-fuel ratio correction signal 29 from the microcomputer 60 to correct the pulse width $T_p$ of the basic injection pulses on the basis of the aforesaid signals, so that injection drive pulses having the pulse width $T_i$ is produced to be fed to a base of an output transistor 24 through an OR gate 23.

A resistor 22 for regulating the current and a parallel circuit of solenoids 20A for controlling injection valves of injectors 20 provided on the respective cylinders are connected in series between a collector of the output transistor 24 and a battery $V_B$. An exciting current flows to the solenoids 20A driving the respective injectors 20 each time the injector drive pulses having the pulse width $T_i$ is applied to the output transistor 24, whereby the valve opening time period corresponding to the pulse width $T_i$ of the injector drive pulses, i.e., the fuel injection flow rate is controlled.

A basic injection pulse cut signal 27 is adapted to be fed to the injection flow rate correcting circuit 50, so as to cut the fuel injection. Injection flow rate increase pulse 28, by which the amount of the fuel injection is increased in non-synchronism with the injector drive pulses, are fed to the OR gate 23 under a specific driving condition of the engine (for example, during acceleration, idling operation or the like).

Both basic injection pulse cut signal 27 and the injection flow rate increase pulses 28 are outputted from a digital output port 58 in the microcomputer 60. Reference numeral 42 indicates a central porcessing unit (CPU) for performing the digital operation concerning various controls including the air-fuel ratio control, 44 a storage element (RAM) capable of being read out and written in, and further, 46 a storage element (ROM) for storing control programs such as an air-fuel ratio control program, etc. and fixed data. Reference numeral 48 is a timer for counting the starting cycles of an interrupting program and the like. Reference numeral 52 is an interruption control section for receiving various interruptions, feeding an interruption signal to the CPU 42 through a bus line 70, and being fed thereto with the basic injection pulses to thereby monitor moments of rises and falls of the basic injection pulses. Reference numeral 54 is a digital input port for taking in detection signals from various sensors outputting digital signals, and inputted to this digital input port 54 are detection output from the $O_2$ sensor 8 for detecting the residual oxygen concentration in the exhaust gas, the throttle sensor 15 for detecting the opening or closing condition of the throttle valve 5, a starter switch 18 for detecting the starting condition of the engine, a clutch switch 19 for detecting the depressed condition of the clutch pedal and a shift switch 33 for detecting the switched condition of a transmission. The present embodiment is of such an arrangement that the starting time of the vehicle is determined by detection outputs of the clutch switch 19 and the shift switch 33.

Further, reference numeral 56 is an analogue to digital (A/D) converter, to which detection analogue signals from the air flow meter 7 and the water temperature sensor 9 are fed so that both signals are converted into digital signals. As aforesaid, reference numeral 58 is the digital output port for outputting the digital basic injection pulse cut signal 27 and the digital injection flow rate increase pulses 28. Reference numeral 62 is a digital to analogue (D/A) converter for outputting the analogue air-fuel ratio correction signal 29.

An input/output interface 80 constituted by the digital input port 54, the digital output port 58, the A/D converter 56 and the D/A converter 62 as described above takes in detection signals from the various sensors to feed the detection signals through the bus line 70 to the CPU 42, where the detection signals are subjected to the operation in accordance with a control program stored in the ROM 46, and thereafter, control signals are outputted to outside from the digital output port 58 and the D/A converter 62.

Figure 4:
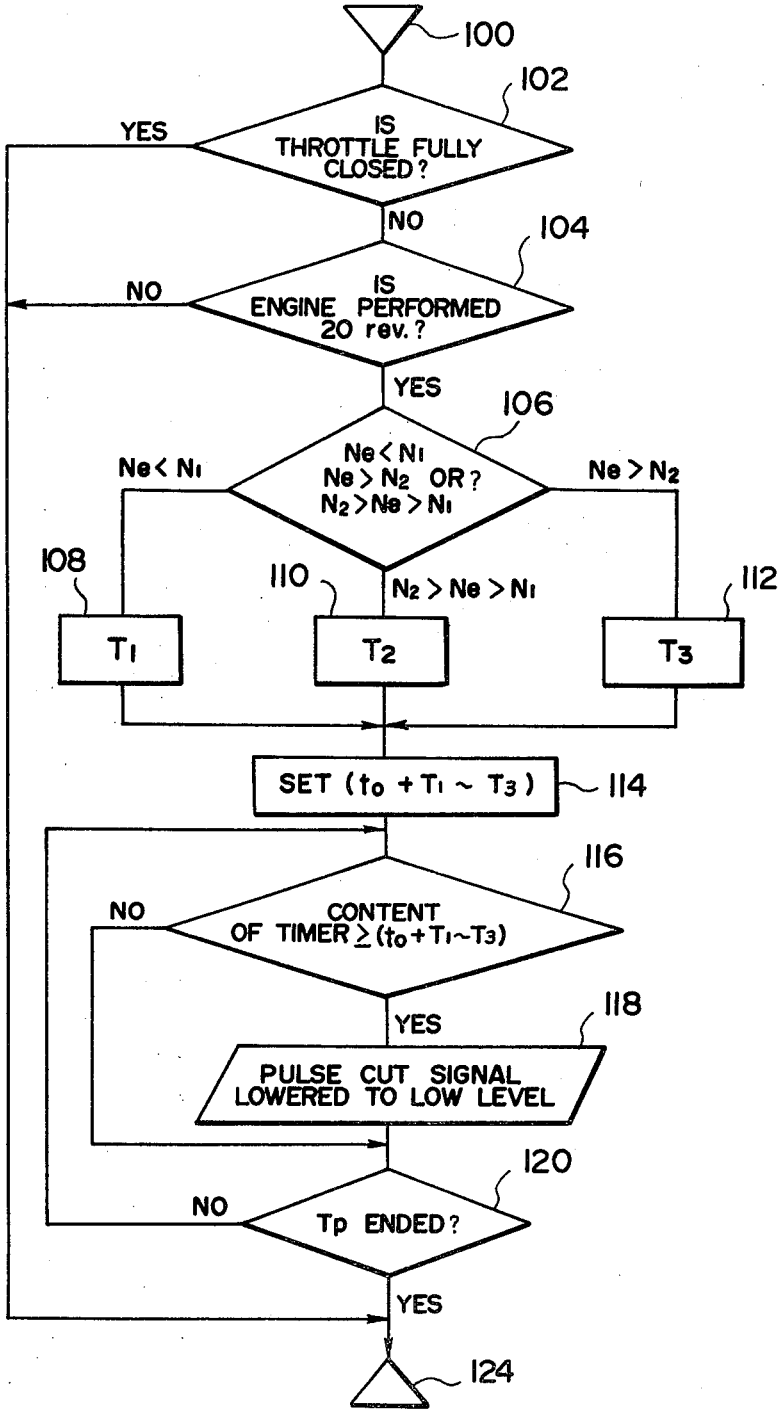
FIG. 4 is a flow chart showing the process of a fuel injection control program.

FIG. 4 shows the processing contents of a fuel injection control program carried out in the control circuit 14.

In the drawing, if the program is started in Step 100, then the process goes forward to Step 102, where it is judged if the throttle valve 5 is fully closed or not. If it is judged that the throttle valve 5 is fully closed, the process skips over to Step 124, thus completing the performance of the program.

On the other hand, when it is judged that the throttle valve 5 is not fully closed, the process goes forward to the succeeding Step 104, where it is judged if a predetermined number of rotations of the engine, e.g., 20 rotations or more have been performed or not since the time when the throttle valve 5, which was fully closed, has opened. Judgement as to whether the engine has performed a predetermined number of rotations or not may be made by a time period that elapsed.

When the engine has not performed 20 rotations since the above-mentioned time in Step 104, the process skips over to Step 124, whereby the performance of this program is completed, so that the injector 20 can be driven in response to the basic injection pulses whose pulse width is corrected in the correcting circuit 50.

On the other hand, when it is judged that the engine has performed 20 or more rotations since the aforesaid time in Step 104, the process goes forward to the succeeding Step 106, where it is judged to what region of the predetermined rotational speed an engine rotational speed $N_e$ belongs. More specifically, in the present embodiment, the regions of rotational speed are divided into three including $N_e<N_1$, $N_1 \leqq N_e \leqq N_2$ and $N_2<N_e$. The smaller the regions of rotational speed are divided into, the higher the control accuracy is improved, however, along therewith, the storage capacity of the storage element should be increased accordingly. In consideration of this respect, a suitable region of rotational speed is to be selected. As shown in FIG. 5, limit values of the basic injection pulses are predetermined corresponding to the respective regions of rotational speed described above. The limit values (upper limit values) of the basic injection pulses are predetermined to $T_1$ when $N_e<N_1$, to $T_2$ when $N_1 \leqq N_e \leqq N_2$, and to $T_3$ when $N_2<N_e$, respectively.

Now, after it has been judged to what region of rotational speed the engine rotational speed $N_e$ belongs in Step 106, the limit values $T_1$, $T_2$ and $T_3$ are selected in Steps 108, 110 and 121, respectively, in accordance with the result of judgings. Now, this moment is assumed to be $t_0$ in the succeeding Step 114, then any one of the limit value $T_1$, $T_2$ and $T_3$ is selected to be added to the time $t_0$. Further, in Step 114, the resulting sum $t_0+T_1$, $t_0+T_2$ or $t_0+T_3$ is set in the timer 48. Then, in the succeeding Step 116, it is judged if the content of the timer 48 has reached the time thus set or not, and, when it is judged that the content of the timer 48 has not yet reached the time thus set, the process skips over to Step 120.

When it is judged that the content of the timer 48 has reached the time thus set in Step 116, the process goes forward to Step 118, where the basic injection pulse cut signal 27 is fed from the digital output port 58 to the injection flow rate correcting circuit 50, whereby the fuel injection time period of the injector 20 is limited. In the present embodiment, this signal 27 is lowered to a low level, thus stopping the injection from the injector 20. Namely, as shown in FIG. 6B, for example, when the time $(t_0+T_1)$ is set in Step 114, if the pulse width $T_p$ of the basic injection pulses is $T_p>T_1$, then the pulse width of the basic injection pulses is restricted so that $T_p$ can be $T_1$.

Further, in Step 120, if a time period corresponding to the pulse width $T_p$ of the basic injection pulses, which is calculated in the basic injection operation circuit 40, has elapsed since the time $t_0$ or not, and, when it is judged that the time period has not elapsed, the process goes back to Step 116 so as to repeat the same process. When it is judged that the time period has elapsed in Step 116, the performance of the program will be completed in Step 124.

Figure 7:
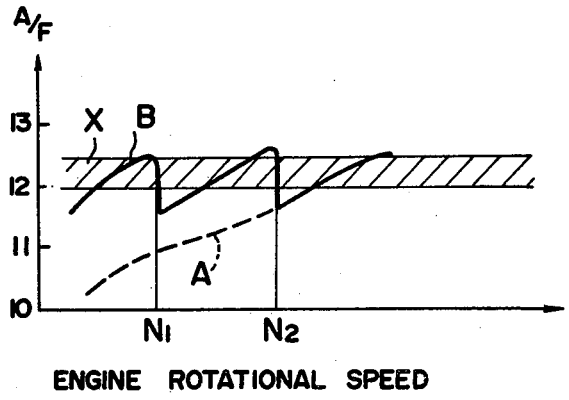
FIG. 7 is an explanatory view showing the air-fuel ratio control operation by the fuel injection control system according to the present invention as compared with the conventional example.

In FIG. 7, an example of air-fuel ratio control in the fuel injection control system according to the present invention is compared with the conventional example under the full-load of the engine. As apparent from FIG. 7, in the conventional system, the air-fuel ratio leaves the optimum air-fuel ratio region X to be over-rich as indicated by a broken line A when the engine is fully loaded. On the other hand, in the present embodiment, the air-fuel ratio is rendered to be within the optimum air-fuel ratio region X as indicated by a solid line B, because the pulse width $T_p$ of the basic injection pulses is controlled within the limit.

Figure 8:
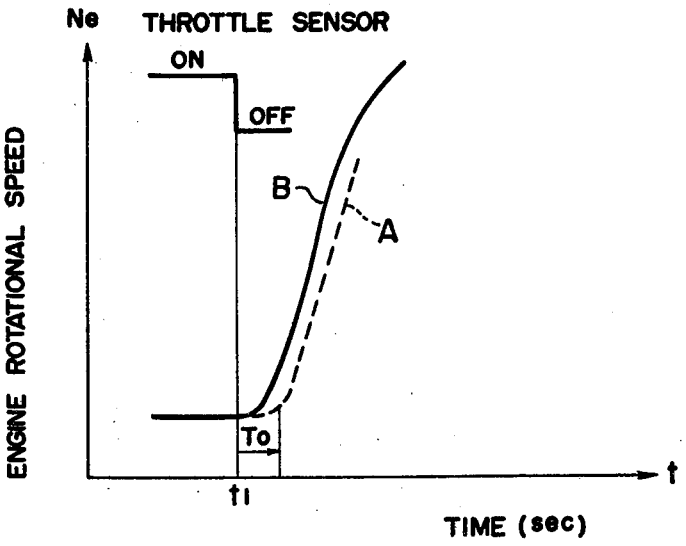
FIG. 8 shows the varying characteristics of the engine rotational speed when the limiting control of the basic injection pulses is temporarily released at the time of racing as compared with the example of the prior art.

FIG. 8 is a diagram showing the characteristics of the engine rotation rise, in which the conventional example is indicated by a broken line A and the case of the present invention by a solid line B. In this conventional example, the basic injection pulse cut as described above can be performed at all times without considering the transitional condition of the engine. Namely, a lag $T_0$ in the rise of the engine rotational occurs since the time $t_1$ when the throttle sensor 15, which has been "ON", is turned "OFF". That is, during transitional operation of the engine where the throttle valve, which has been fully closed, begins to open, an over-rich air-fuel ratio as compared with that during normal condition is required. However, in the conventional example, since the basic injection pulses described above are cut even during transitional condition in accordance with the rotational speed of the engine, the output of the engine is lowered, whereby the lag $T_0$ occurs. On the other hand, in the embodiment of the present invention, the basic injection pulse signal described above is not cut during transitional condition of the engine, and hence, during transitional condition, an over-rich air-fuel ratio as compared with that during normal condition can be obtained, so that the characteristics of the engine rotation rise can be improved as indicated by the solid line B. In consequence, the response during racing can be improved, for example.

What is claimed is:

1. A fuel injection control system comprising:

an injector for injecting fuel;

engine rotational speed detecting means for detecting an engine rotational speed;

air flow rate detecting means for detecting an intake air flow rate;

transitional condition detecting means including a throttle sensor detecting closed and opened states of a throttle valve, said transitional condition detecting means detecting a moment at which the throttle valve begins to open from the closed state on the basis of a result of detection of said throttle sensor, detecting whether or not said engine has performed a predetermined number of rotations since said moment on the basis of a signal from said engine rotational speed sensor, and judging said engine to be in a transitional condition until said engine has performed the predetermined number of rotations;

a pulse generator for generating a basic injection pulse signal having a pulse width determined by the engine rotational speed and an engine intake air flow rate;

air-fuel ratio correcting means for producing a pulse cut signal while no transitional condition of the engine is judged by said transitional condition detecting means, said pulse cut signal interrupting said basic injection pulse signal; and a driving device for driving said injector when said basic injection pulse signal is fed to said driving device from said pulse generator and deenergizing said injector when said pulse cut signal is produced from said air-fuel ratio correcting means.

2. A fuel injection control system as set forth in claim 1, wherein said engine rotational speed detecting means comprises an engine rotation sensor for dividing an ignition coil primary signal generated in an ignition circuit to detect said engine rotational speed; and said intake air flow rate detecting means comprises an air flow rate sensor for detecting said intake air flow rate from a rotational angle of a measuring plate rotatably driven in accordance with an intake air flow.

3. A fuel injection control system as set forth in claim 1, wherein said air-fuel ratio correcting means includes a timer which counts a time period for limiting the pulse width, said time period being selected in accordance with said detected engine rotational speed, whereby when a content of said timer coincides with said time period for limiting the pulse width, said pulse cut signal is generated to interrupt said basic injection pulse so that said driving device is deenergized.

4. A fuel injection control system as set forth in claim 1, wherein said driving device comprises a power source, a solenoid to be energized by said power source and a switch for controlling a current passage to said solenoid, and the current passage to said solenoid is cut in response to said pulse cut signal.

5. A fuel injection control system as set forth in claim 1 futher comprising a pulse width correcting circuit for correcting the pulse width of said basic injection pulse signal fed thereto in accordance with an engine cooling water temperature and an intake air temperature, whereby said driving device is energized or deenergized in response to the corrected basic fuel injection pulse signal output from said pulse width correcting circuit.

6. A fuel injection control system comprising:

an injector for injecting fuel;

a driving device including a power source, a solenoid to be energized by said power source and a switch for controlling a current passage to said solenoid, for driving said injector;

an engine rotational speed sensor for detecting an engine rotational speed;

an intake air flow rate sensor for detecting an intake air flow rate in accordance with an angle of rotation of a measuring plate rotatably driven commensurate to an intake air flow;

a pulse generator for generating a basic fuel injection pulse signal having a pulse width calculated from an engine rotational speed signal fed from said engine rotational speed sensor and an intake air flow rate signal fed from said intake air flow rate sensor, said switch driven in response to said basic fuel injection pulse signal;

detecting means including a throttle sensor to be energized when a throttle valve is substantially fully closed, for detecting a moment at which said throttle valve begins to open by said throttle sensor, for detecting in response to said engine rotational speed signal whether or not said engine has performed a predetermined number of rotations since said moment, whereby a transitional condition of said engine is judged until said engine has performed the predetermined number of rotations; and an air-fuel ratio correcting means including a timer for generating a pulse cut signal when a content of said timer coincides with a time period selected in accordance with the detected engine rotational speed while the transitional condition of said is not detected by said transitional condition detecting means, said pulse cut signal interrupting said basic fuel injection pulse to switch off said switch so that said current passage to said solenoid is cut so as to deenergize said injector through said driving device, whereby said air-fuel ratio is corrected.

7. A fuel injection control system as set forth in claim 6 further comprising pulse width correcting means for correcting the pulse width of said basic fuel injection pulse signal fed thereto in accordance with an engine cooling water temperature and an intake air temperature, whereby said driving device is energized or deenergized in response to the corrected basic fuel injection pulse signal output from said correcting means.

8. A fuel injection control system as set forth in claim 6, wherein said engine rotational speed sensor detects the engine rotational speed by dividing an ignition coil primary signal generated in an ignition circuit.

* * * * *